US005526830A

United States Patent [19]

Hunter

[11] Patent Number: 5,526,830

[45] Date of Patent: Jun. 18, 1996

[54] MULTISENSORY DECORATIVE HAIR BOW

[76] Inventor: Christina J. Hunter, 11124 Concord Woods Dr., Knoxville, Tenn. 37922

[21] Appl. No.: 396,008

[22] Filed: Feb. 28, 1995

[51] Int. Cl.[6] ..... A45D 8/12; A47G 33/04

[52] U.S. Cl. ..... 132/275; 132/273; 132/276; 132/277; 428/7; 428/11

[58] Field of Search ..... 132/273, 275, 132/276, 277; 428/4, 5, 7, 11; 40/124.1, 455, 457

[56] References Cited

U.S. PATENT DOCUMENTS

| | | | |
|---|---|---|---|
| D. 234,467 | 3/1975 | DelGrosso | D29/1 R |
| D. 308,185 | 5/1990 | Valkner | D11/184 |
| 595,926 | 12/1897 | Skillen | 132/275 |
| 926,450 | 6/1909 | Yeomans | 132/275 |
| 1,007,586 | 10/1911 | Martin | 132/275 |
| 2,104,248 | 2/1936 | Stark | 223/46 |
| 2,105,436 | 1/1938 | Flatto | 132/47 |
| 3,630,810 | 12/1971 | Mauro | 161/9 |
| 4,339,059 | 7/1982 | Kenyon | 223/46 |
| 4,409,931 | 1/1985 | Fleemin | 40/406 |
| 4,525,393 | 6/1985 | DiCostanzo | 428/7 |
| 4,597,099 | 6/1986 | Sawafuji | 381/90 |
| 4,608,771 | 9/1986 | Mehta | 40/427 |
| 4,882,966 | 11/1989 | Silverman | 84/94 |
| 4,923,721 | 5/1990 | Gilmore | 428/11 |
| 5,044,037 | 9/1991 | Brown | 15/105 |
| 5,100,706 | 3/1992 | Zaweski | 428/4 |
| 5,115,472 | 5/1992 | Park | 40/455 |
| 5,215,791 | 6/1993 | Davignon | 428/5 |
| 5,245,171 | 9/1993 | Fox | 40/455 |

*Primary Examiner*—Cary E. O'Connor
*Assistant Examiner*—Pedro Philogene
*Attorney, Agent, or Firm*—Pitts & Brittian

[57] ABSTRACT

A multisensory decorative hair bow, or bow (10), for providing an audible message such as music, spoken words, or sound effects upon the activation of an acoustic element (22). The bow (10) is designed to adorn a wearer by placement in the person's hair. A conventional bow (12) is provided with an acoustic device (22) secured thereto in a conventional manner. A control switch (24) is carried by the acoustic device (22) such that when selectively engaged, the acoustic device (22) produces the audible message. A covering member (30) may be provided to cover the acoustic device (22) to hide the same from sight.

2 Claims, 2 Drawing Sheets

MULTISENSORY DECORATIVE HAIR BOW

This application in part discloses and claims subject matter disclosed in my earlier filed pending application Ser. No. 08/114,835 filed on Sep. 2, 1993.

TECHNICAL FIELD

This invention relates to the field of decorative bows. More specifically, this invention relates to the field of hair bows or the like which include a device for producing a selected audible message, songs or other tone.

BACKGROUND ART

Hair bows have been used for personal adornment by various cultures throughout the world and throughout the centuries. They are most typically used as a means of securing the hair in a neat fashion while at the same time enhancing the feminine appearance by the incorporation of a wide variety of colors, fabrics, materials, styles and sizes in the construction of the hair bow. The popularity and specific design of hair bows is greatly influenced by the hair and fashion industry. For this reason hair bows are constructed to complement hair and fashion trends as well as individual characteristics of the bow wearer.

To date, the design emphasis of hair bows has focused on the visual presentation of the bow. Hair bows are often worn to make a fashion statement, and through their visual presentation may reflect a specific "theme" based on the individual bow wearer's personal style, interests, or the event for which the bow is designed to be worn.

Many different bows have been designed to accomplish different tasks. Typical of the art are those bows disclosed in the following United States Letters Patents:

| Pat. No. | Inventor (s) | Issue Date |
|---|---|---|
| 2,104,248 | W. Stark | Jan 4, 1938 |
| 2,105,436 | G. Flatto | Jan 11, 1938 |
| 3,630,810 | V.D. Mauro | Dec 21, 1971 |
| 4,339,059 | D.A. Kenyon | Jul 13, 1982 |
| 4,490,931 | J.D. Fleemin | Jan 1, 1985 |
| 4,525,393 | P DiCostanzo | Jun 25, 1985 |
| 4,608,771 | S. Mehta | Sep 2, 1986 |
| 4,882,966 | B. Silverman | Nov 28, 1989 |
| 4,923,721 | W.M. Gilmore | May 8, 1990 |
| 5,044,037 | K.A. Brown | Sep 3, 1991 |
| 5,100,706 | L. Zaweski | Mar 31, 1992 |
| 5,215,791 | E.A. Davignon | Jun 1, 1993 |
| Des. 234,467 | E.V. Del Grosso | Mar 11, 1975 |
| Des. 308,185 | C.A. Valkner | May 29, 1990 |

Several of these patents disclose hair bows and ornamental bows for packages. Others disclose ornamental devices which incorporate conventional music producing devices. However, none of these discloses a bow including an audibly detectable message.

One deficiency of prior hair bow designs is that the extent to which a given theme can be expressed by a particular design of bow is limited when the representation of that theme is restricted to a single sensory modality the visual modality. This and other limitations experienced with the prior art design of hair bows have been obviated in a novel manner by the present invention.

It is, therefore, an object of the invention to improve upon the current presentation of personal adornment accessories, namely ribbon, cloth, ceramic material, ceramic-like material, and plastic hair bows, by incorporating a novel acoustic device for producing music, songs, spoken words or sound effects.

It is another object of the present invention to provide a bow having an acoustic element wherein the sounds produced therein are selected with a particular theme in mind so that the acoustic aspect of the bow fully complements and augments the theme that is expressed by visual ornamental aspects of the bow.

Another object of the present invention is that while it augments the artistic, aesthetic, and message value (theme expression) of the bow, it also adds a multisensory or heightened sensorial experience component for both the wearer of the bow and the person viewing the bow by providing an intensified presentation of the bow theme through the stimulation of combined modalities.

A further object of the present invention is to provide greater direct enjoyment of the bow by the bow wearer once it has been placed in the hair.

DISCLOSURE OF THE INVENTION

Other objects and advantages will be accomplished by the present invention which serves to provide an audible message such as music, spoken words, or sound effects upon the activation of an acoustic element. Moreover, the bow of the present invention is designed to adorn a wearer or a package in a typical manner as do other bows.

A standard bow may be used in the present invention. The bow may include a plurality of loops and a plurality of free ends. A centrally placed tie-down member is provided to maintain the shape of the bow by retaining the individual pieces of ribbon or other material in tight fashion. The bow is provided with a conventional means for securing the bow to a person's hair. Any other configuration of bow may be incorporated as well. A conventional acoustic device is provided for producing a selected sound at a selected time by activation of a control switch. The acoustic device may be secured to the bow in a conventional fashion such as with glue. The acoustic device may be secured to the bow in any selected location such as at the geometric center of the bow.

A covering member may be provided to cover the acoustic device to hide the same from sight. Although it is not required, the covering member may add decorative value to the bow of the present invention. In other embodiments wherein alternate configurations of the acoustic devices are incorporated, a covering member may not be desirable due to the aesthetic qualities of the acoustic device itself.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

A multisensory decorative item incorporating various features of the present invention is illustrated generally at 10 in the figures. The multisensory decorative item, or bow 10, is designed for providing an audible message 26 such as music, spoken words, or sound effects upon the activation of an acoustic element 22. Moreover, in the preferred embodiment the bow 12 is designed to adorn a wearer by being put in the wearer's hair.

Figure 1:
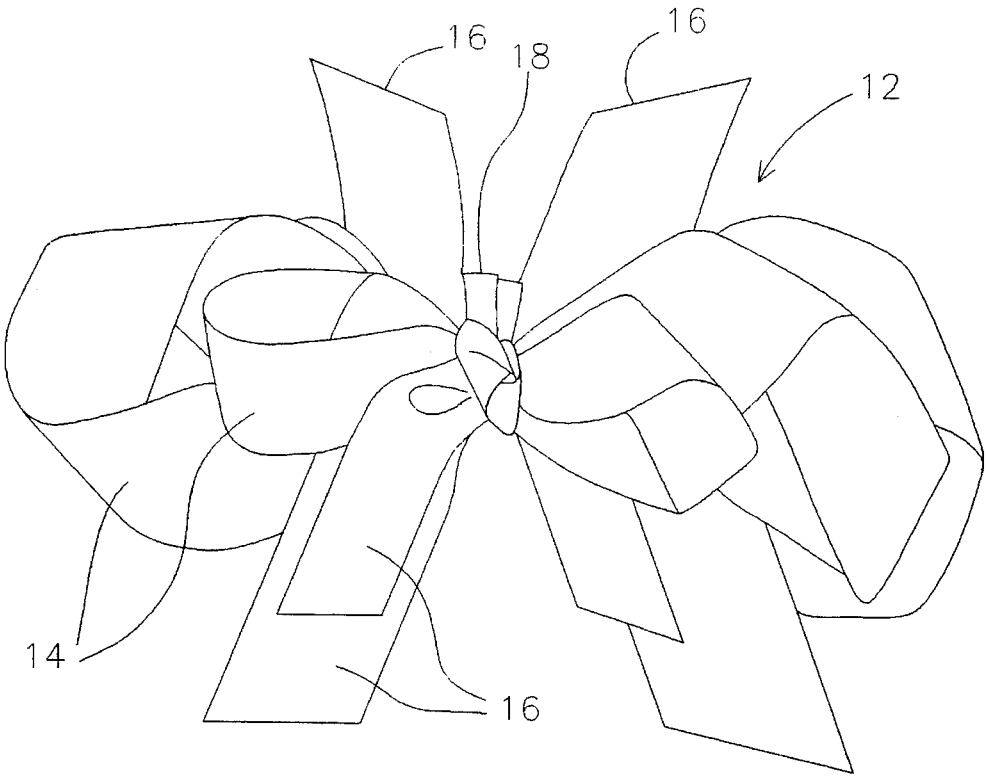
Fig. 1 PRIOR ART
FIG. 1 is a top plan view of an ornamental bow which is typical of the prior art.

FIG. 1 illustrates a typical bow 12 disclosed in the prior art. The bow 12 includes a plurality of loops 14 and a plurality of free ends 16. A centrally placed tie-down member 18 is provided to maintain the shape of the bow 12 by retaining the individual pieces of ribbon or other material in tight fashion, the central portion of the bow 10 being gathered in conventional fashion. The bow 12 is provided with a conventional means for securing the bow to a person's hair.

Figure 2:
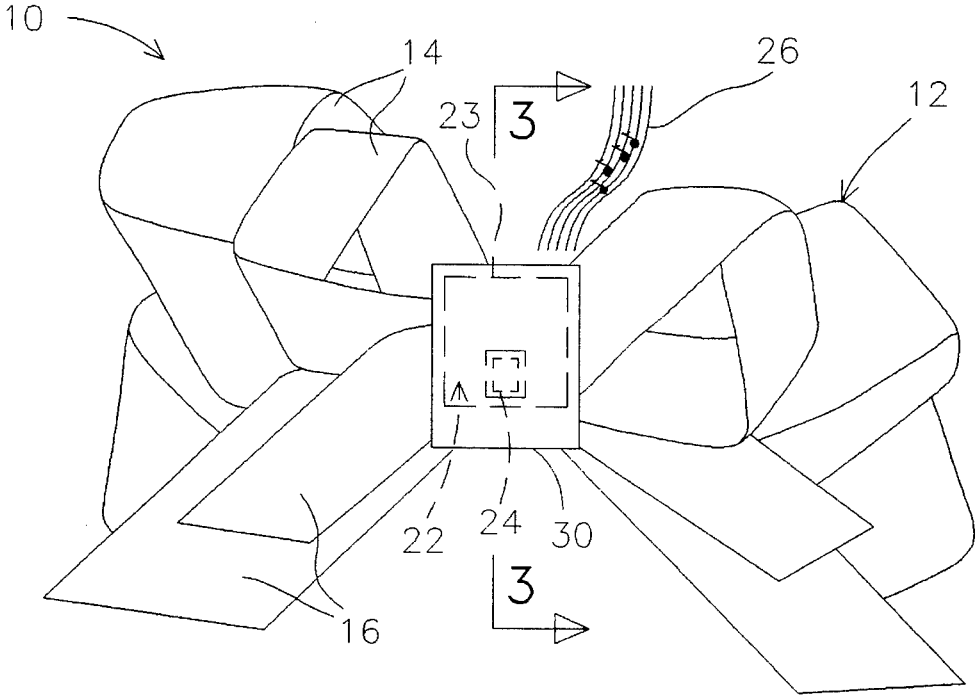
FIG. 2 is a top plan view of the multisensory decorative item constructed in accordance with several features of the present invention.
Figure 3:
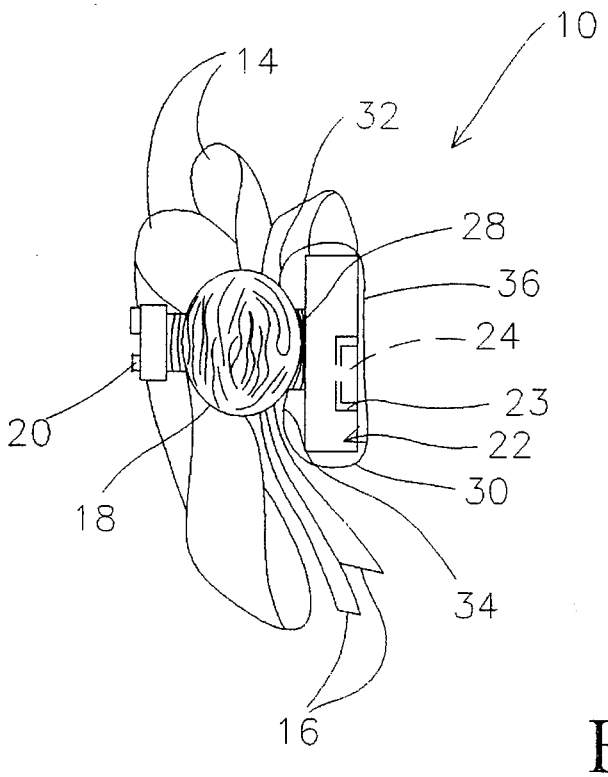
FIG. 3 is a side elevation view, in section, of the multisensory decorative item of the present invention taken along lines 3—3 of FIG. 2.

FIG. 2 illustrates one preferred embodiment of the present invention. In this embodiment, a bow 12 such as that illustrated in FIG. 1 may be used. It will be seen that any other configuration of bow may be incorporated as well. An acoustic device 22 is provided for producing a selected sound 26 at a selected time by activation of a control switch 24. The acoustic device 22 may be any conventional acoustic device readily available in the market. As illustrated, the preferred acoustic device 22 is a small, lightweight device including an electrical circuitry (not shown) carried within a lightweight housing 23. The electrical circuitry includes a memory device for storing a pre-recorded tune or message such as a college fight song or other selected tune. The control switch 24 is engaged to initiate the playback of the pre-recorded selected tune or message.

The acoustic device 22 is shown being attached to the bow 12 proximate the tie-down member 18 in a conventional manner such as with glue 28. However, it will be seen that the acoustic device 22 may be disposed at any other location on the bow 12, such as at one of the plurality of free ends 16. Further, it will be seen that other conventional means may be used for securing the acoustic device 22 to the bow 12.

A covering member 30 is provided to cover the acoustic device 22 to hide the same from sight. As shown, the covering member 30 defines first and second ends 32,34, each of which is secured to the bow 12 in a selected fashion, with a central portion 36 of the covering member 30 being positioned such that the acoustic device 22 is disposed between the covering member 31 and the bow 12. Although it is not required, the covering member 30 may add decorative value to the bow 10 of the present invention. In other embodiments wherein alternate configurations of the acoustic devices 22 are incorporated (see FIGS. 4 and 5), a covering member 30 may not be desirable due to the aesthetic qualities of the acoustic device 22 itself.

In the present invention, the acoustic aspect of the bow 10 is selected with a particular theme in mind in order to complement the visual ornamental aspects of the bow 10, such as: bow color; decoratively drawn or glued figures added to the geometric bow center, bow tail or free ends or other obvious and visible location; and bow shape. For example, an acoustic device 22 may be selected to match visual decorative aspects of the bow 10 which may include the theme of a particular school wherein the acoustic device 22 produces the school song.

Figure 4:
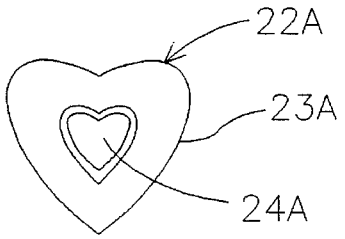
FIG. 4 illustrates an alternate embodiment of the acoustical device of the present invention.
Figure 5:
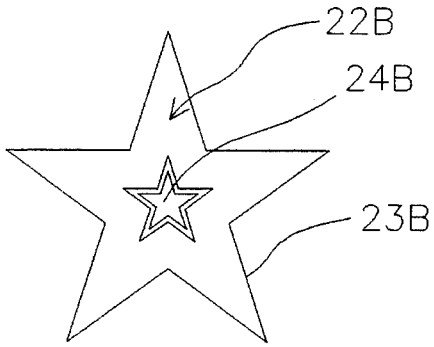
FIG. 5 illustrates an alternate embodiment of the acoustical device of the present invention.

Other examples include the use configuration of a heart-shaped acoustic device 22A, as shown in FIG. 4, which might produce a love song or a recorded love note. As shown in FIG. 5, the acoustic device 22B may be shaped as a star and produce an appropriate song about stars. It would be anticipated that many other designs may be used for events such as birthdays, holidays, and other occasions with appropriate music or messages may be produced by the acoustic device.

The bow 10 of the present invention is provided with a fastening device 20 for securing the bow 10 to a selected object. In the preferred embodiment, the fastening device 20 is a conventional hairclip for securing the bow 10 in a person's hair. Of course, other conventional devices may be used as well in order to secure the bow 10 in a person's hair or on another selected object.

From the foregoing description, it will be recognized by those skilled in the art that a multisensory decorative item offering advantages over the prior art has been provided. Specifically, the multisensory decorative item provides a means whereby a decorative bow may be pleasing both audibly as well as visually. An acoustic device is provided for producing an appropriate song or message according to the otherwise visual theme for which the user is using the bow. The bows may be worn in a person's hair.

It is also anticipated that the bows of the present invention may be worn by the visually-, speech- or hearing-impaired in order to participate in public events such as school athletic events. For instance, whereas a sight-impaired person might wear a conventional bow and gain no enjoyment whatsoever, that person may wear the ornamental bow of the present invention and activate the acoustic device in order to gain audible pleasure from the bow. On the other hand, a speech- or hearing-impaired person who has no or limited ability to emit sound may wear the ornamental bow of the present invention and allow the acoustic device to act as his/her voice to show enthusiasm or excitement at appropriate times.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A multisensory ornamental hair bow comprising:

an ornamental bow fabricated from a ribbon material defining a plurality of loops and a plurality of free ends, a tie-down member being provided at a gathered portion at a geometric center of said ornamental bow to maintain said plurality of loops and said plurality of free ends in tight fashion;

a conventional acoustic device secured to said ornamental bow proximate said geometric center thereof for playing a selected prerecorded audible message, said conventional acoustic device including a memory device for storing said prerecorded selected audible message, and a lightweight housing;

a control switch carried by said conventional acoustic device for activating said conventional acoustic device to playback said selected audible message, said control switch being a push-button type switch which may be depressed in order to activate said conventional acoustic device to produce said selected audible message;

a hairclip carried by said ornamental bow for securing said ornamental bow in a conventional fashion to a person's hair; and a covering member for covering at least said conventional acoustic device; said covering member and a portion of said ornamental bow cooperating to define a volume for receiving said conventional acoustic device said covering member being fabricated from said ribbon material, said ribbon material being flexible to allow engagement of said control switch therethrough.

2. The multisensory ornamental hair bow of claim 1 wherein said conventional acoustic device is secured to said ornamental bow using an adhesive.

* * * * *